US006056378A

United States Patent [19]

Semon et al.

[11] Patent Number: 6,056,378

[45] Date of Patent: May 2, 2000

[54] ADD-ON DRAWER AND METHOD OF MOUNTING

[75] Inventors: James M. Semon, Westlake; Annemarie Kahl, Avon Lake; Jeffrey S. Plantz, Seven Hills, all of Ohio

[73] Assignee: Manco, Inc., Avon, Ohio

[21] Appl. No.: 09/167,342

[22] Filed: Oct. 7, 1998

[51] Int. Cl.[7] ..... A47B 88/04

[52] U.S. Cl. ..... 312/246; 312/334.33; 312/334.44

[58] Field of Search ..... 312/194, 245, 312/246, 330.1, 334.23, 350, 333, 334.44, 404; 108/25, 26, 93; 248/298.1

[56] References Cited

U.S. PATENT DOCUMENTS

| | | | |
|---|---|---|---|
| 2,174,582 | 10/1939 | Hudon | 312/246 X |
| 2,176,782 | 10/1939 | Bargen | 312/246 |
| 2,478,017 | 8/1949 | Shoemaker | 312/246 X |
| 3,729,242 | 4/1973 | Barney | 312/107 |
| 4,632,472 | 12/1986 | Bross | 312/246 |
| 4,708,487 | 11/1987 | Marshall | 312/245 X |
| 4,783,971 | 11/1988 | Alba | 312/350 X |
| 4,927,215 | 5/1990 | Katz | 312/245 X |

*Primary Examiner*—Janet M. Wilkens
*Attorney, Agent, or Firm*—Vickers, Daniels & Young

[57] ABSTRACT

An add-on drawer is provided for mounting onto a structure having a horizontal member with a lower surface. The drawer comprises a tray with a storage space, and at least two rails slidably supporting the tray. Each rail has a top surface including an upwardly facing adhesive for mounting the rails onto the lower surface of the horizontal member.

11 Claims, 2 Drawing Sheets

ADD-ON DRAWER AND METHOD OF MOUNTING

The present invention relates to the art of drawers and more particularly to add-on drawers for mounting on a structure having a horizontal member with a lower surface.

BACKGROUND OF THE INVENTION

Drawers are well known in the art and are commonly incorporated into structures such as desks, cabinets, and tables to provide convenient, retractable access to storage spaces. Such retractable storage is especially useful in the workplace where various tools and implements must be accessed frequently while at the same time the main horizontal work surface of the structure must be kept clear. An example is an ordinary office desktop which is generally kept clear of tools to allow papers to be laid flat upon the desktop surface and worked upon. Typically, a pencil drawer is provided directly beneath the desktop from which pens, pencils, erasers, scissors and the like are periodically retrieved to be used in working on the papers.

Drawers commonly include a horizontal tray with a storage space having one or more compartments which is supported between two horizontal rails for slidable movement along a horizontal axis parallel to the rails. A drawer is typically mounted directly below a horizontal member such that access to the storage space is limited when the tray is moved to a closed position wherein the storage space is entirely beneath the horizontal member. Desks commonly include a drawer mounter below the horizontal desktop working surface and above the leg space provided for a user. This drawer is usually shallow and used primarily for storing pencils and other common office implements such as paper clips, rubber bands and the like.

Applicants have found that, in the workplace, a need often arises for mounting a drawer underneath a horizontal work surface such as a table or workbench or bookshelf. In this situation, an add-on drawer is desirable for mounting onto the lower surface of a horizontal member to provide the retractable storage space. Prior to the present invention, no drawer was available which could be quickly and easily added to such a surface.

Prior drawers are typically mounted onto a bench or table using threaded fasteners to attach the rails to the lower surface of the table or bench. This mounting arrangement requires several tools and excessive time. Holes must be drilled into the table, and may need to be tapped depending on the table material. Because the rails must be mounted parallel to one another to properly support the slidable tray, measurements must be taken and markings carefully made prior to drilling. In addition, the drawer including tray and rails, or the rails if separate, must be supported while the fasteners are installed. Finally, where the horizontal member of the table or workbench is thin, mounting a drawer to the lower surface using threaded fasteners may be impossible without penetrating and thereby ruining the top work surface of the table.

SUMMARY OF THE INVENTION

The present invention minimizes or overcomes the shortcomings of the prior art in providing an add-on drawer which can be quickly mounted onto the lower surface of a horizontal member. In accordance with the principal aspect of the invention, there is provided an add-on drawer including at least two rails slidably supporting a tray, each rail having an upwardly facing adhesive for mounting to the lower surface of a horizontal member.

In accordance with another aspect of the invention, the add-on drawer includes removable non-adhesive strips covering the upwardly facing adhesive which can be removed prior to mounting.

In accordance with another aspect of the invention, the drawer includes holes through the rails, the adhesive, and the non-adhesive strip.

In accordance with another aspect of the invention, the drawer includes a stop which prevents the tray from being completely removed from the support of the rails.

In accordance with yet another aspect of the invention, there is provided a method of mounting an add-on drawer to a structure having a horizontal member with a lower surface quickly, and without using any tools.

A primary object of the present invention is the provision of an add-on drawer of the character for mounting onto a structure having a horizontal member with a lower surface.

Another object of the present invention is the provision of an add-on drawer of the type described above which can be quickly and easily installed without drilling or modifying the horizontal member, and without any tools.

Another object of the present invention is the provision of an add-on drawer of the type described above which can be mounted on the lower surface of thin horizontal members without penetrating or otherwise ruining the horizontal member upper surface.

Yet another object of the present invention is the provision of an add-on drawer of the type described above which prevents a user from unintentionally spilling the contents of the tray.

Still another object of the present invention is the provision of a method of mounting an add-on drawer to a structure having a horizontal member with a lower surface without drilling or tapping any holes in the horizontal member.

BRIEF DESCRIPTION OF THE DRAWINGS

The foregoing and other objects and advantages will become apparent from the following description of a preferred embodiment of the present invention illustrated in the accompanying drawings which form a part thereof and in which.

DESCRIPTION OF A PREFERRED EMBODIMENT

Figure 1:
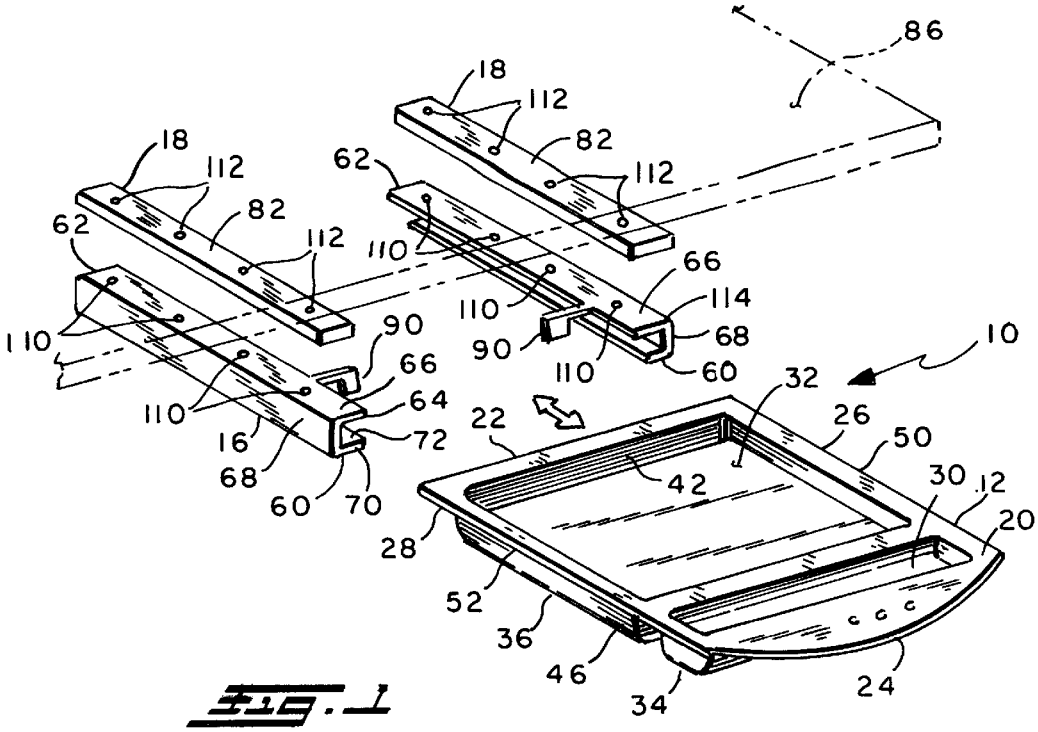
FIG. 1 is an exploded perspective view of an add-on drawer according to the invention.
Figure 2:
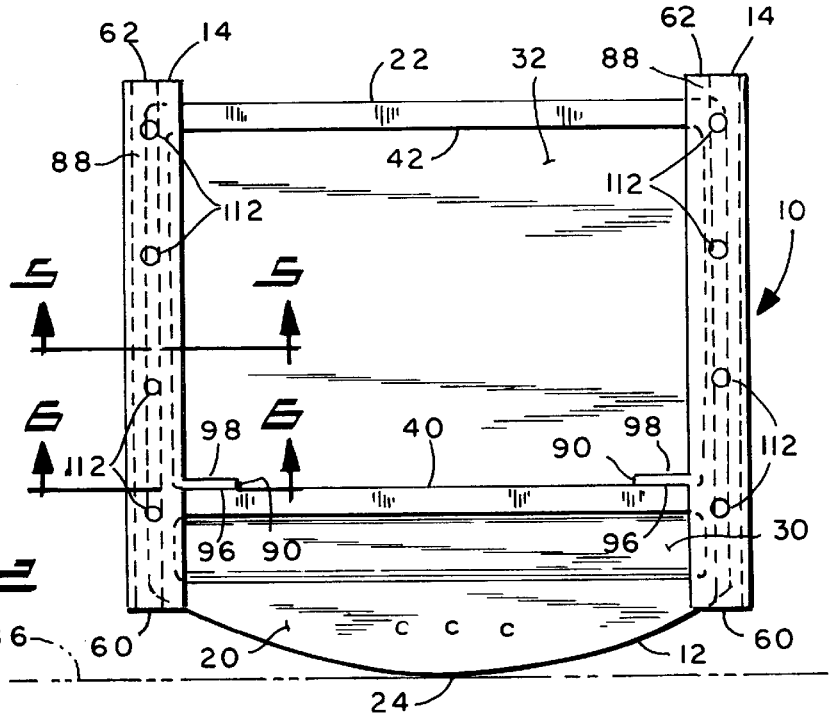
FIG. 2 is a plan view of the add-on drawer in a closed position.
Figure 3:
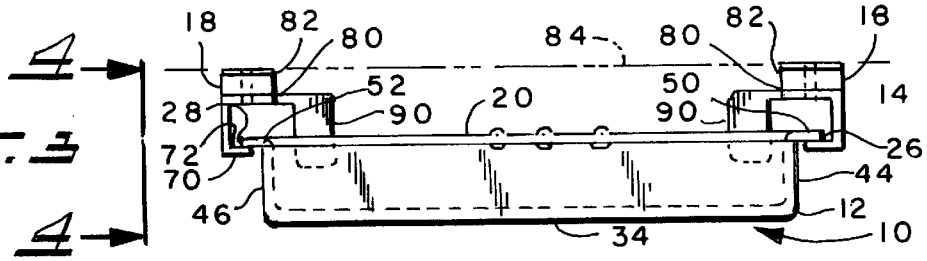
FIG. 3 is a front elevation view of the add-on drawer mounted on a horizontal member lower surface.
Figure 4:
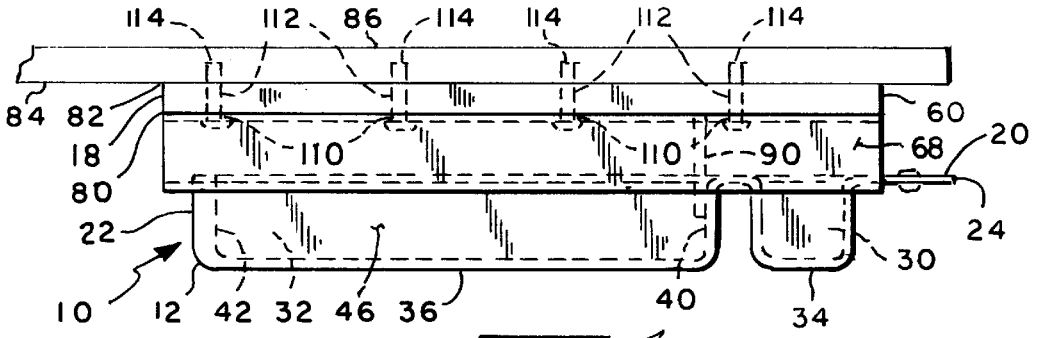
FIG. 4 is a side elevation view of the add-on drawer mounted on a horizontal member lower surface in a closed position.

Referring now to the drawings wherein the showings are for the purpose of illustrating a preferred embodiment of the invention only, and not for the purpose of limiting the same, FIG. 1 shows an add-on drawer 10 comprised of a tray 12 and rails 14 and 16, each rail having an adhesive strip 18 to be discussed further hereinafter. Strips 18 are preferably preinstalled on rails 14 and 16; however, in FIG. 1, the strips are shown separate for clarity. Referring also to FIG. 4, the tray 12 is preferably a single molded piece having a horizontal top surface 20 extending longitudinally from a rear edge 22 to an arcuate front edge 24 and laterally between two side edges 26 and 28. The tray 12 further includes front and rear cavities 30 and 32 extending downwardly from top surface 20. The front cavity 30 has a front bottom surface 34 and the rear cavity 32 has a rear bottom surface 36. Referring now to FIGS. 2, 3 and 4, the rear cavity 32 has a front sidewall 40, a rear sidewall 42, a right sidewall 44 and a left sidewall 46. As shown in FIG. 3, the top surface 20 extends laterally past the cavity sidewalls 44 and 46 to side edges 26 and 28, thus defining respectively outwardly extending flanges 50 and 52.

Figure 5:
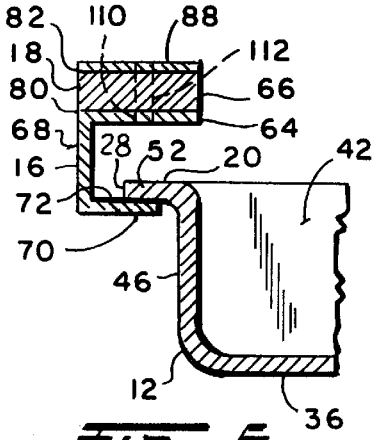
FIG. 5 is a sectional front elevation view of the left most portion of the add-on drawer taken along line 5—5 in FIG. 2.
Figure 6:
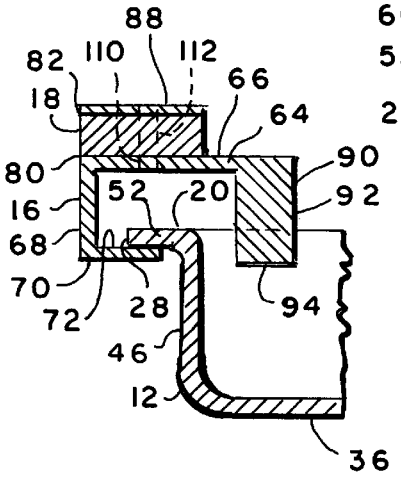
FIG. 6 is a sectional front elevation view of the left most portion of the add-on drawer taken along line 6—6 in FIG. 2; and, FIG. 7 is a plan view of the add-on drawer in an opened position.
Figure 7:
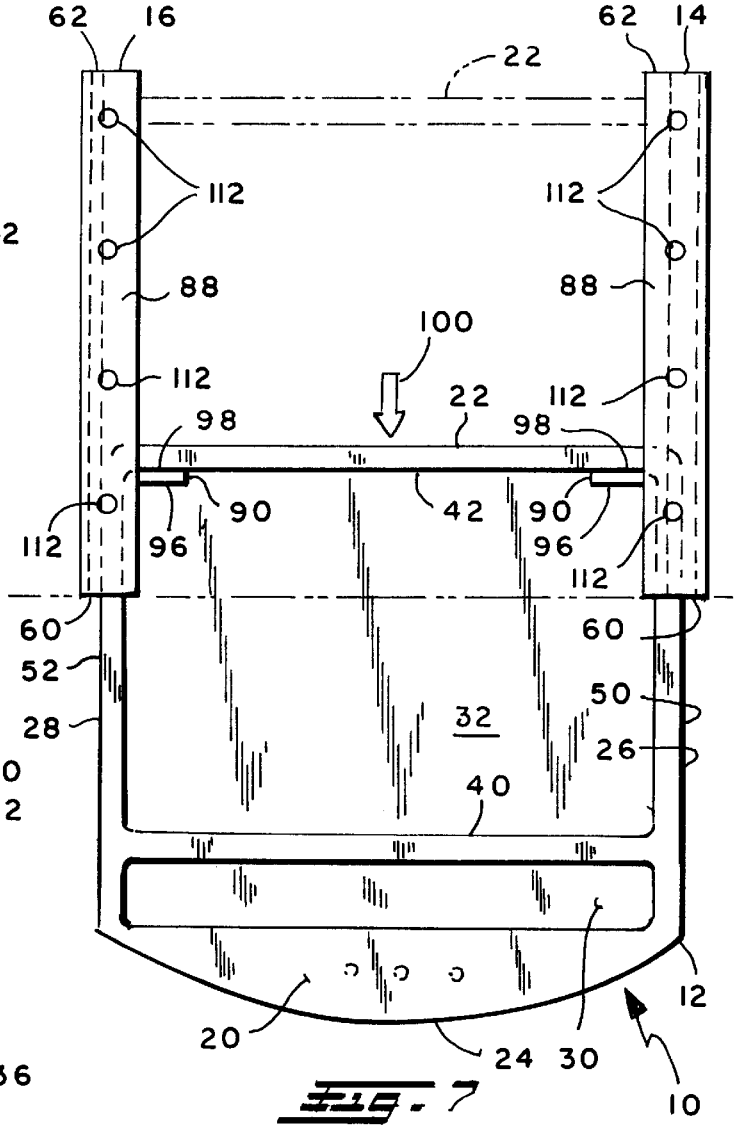

As shown in FIG. 1, the two rails 14 and 16 are symmetrical mirror images of each other, and thus the following description of rail 16 applies as well to rail 14. Referring now to FIGS. 5, 6, and 7, the left side rail 16 extends longitudinally from a front end 60 to a rear end 62 and includes a top member 64 with a top surface 66. The rail 16 further includes a side member 68 located vertically between the top member 64, and a horizontal lower member 70. The lower member 70 has an upper surface 72. The rail 16 thus forms an inwardly facing C-shaped channel whereby the channels of the right and left side rails 14 and 16 face each other and the upper surfaces 72 of the lower members 70 thereof support the outwardly extending flanges 50 and 52 of the tray 12. This provides slidable longitudinal movement of the tray 12 between a closed position wherein the storage cavities 30 and 32 are entirely located between and lateral of the rails 14 and 16 as shown in FIG. 2, and an opened position as shown in FIG. 7 wherein the cavities 30 and/or 32 are partially located forward past the front end 60 of the rails 14 and 16.

Referring now to FIGS. 4 and 5, lower adhesive surfaces 80 of the adhesive strips 18 are attached to the upper surfaces 66 of the rails 14 and 16. The upper adhesive surfaces 82 of the strips 18 are attached to a lower surface 84 of a horizontal member 86 thereby mounting the rails 14 and 16 which in turn slidably support the tray 12. Prior to their being mounted onto the horizontal member 86 as further described herein, the strips 18 preferably include removable non-adhesive strips 88 covering and thus protecting and preserving the upper adhesive surfaces 82.

As best seen in FIGS. 3 and 6, the rails 14 and 16 preferably include stops 90 extending from the rail top members 64 inwardly to an inner edge 92 and downwardly below the horizontal top surface 20 to a lower edge 94. The stops 90 limit the range of longitudinal travel of the tray 12 with respect to the rails 14 and 16. This in turn limits the travel of the tray 12 with respect to the horizontal member 86 between the closed position of FIG. 2 wherein the sidewall 40 engages the front surfaces 96 of the stops 90, and the opened position of FIG. 7 wherein the sidewall 42 engages the rear surfaces 98 of the stops 90. Consequently, when a user opens the drawer 10 by sliding the tray 12 in the longitudinal direction of arrow 100 in FIG. 7, the tray 12 cannot be fully withdrawn from the engaging support of the rails 14 and 16. This prevents the user from accidentally spilling the contents of the storage cavities 30 and/or 32. Likewise, the stops 90 prevent the user from sliding the tray 12 in the longitudinal direction opposite that of arrow 100 past the closed position of FIG. 2. Thus, the tray 12 always remains in supported engagement with the rails 14 and 16.

Referring again to FIGS. 1 and 4, the drawer 10 preferably includes holes 110 through the top members 64 of the rails 14 and 16 and corresponding holes 112 in the adhesive strips 18, and the non-adhesive strips 88. This gives the user the option of installing the drawer 10 to the horizontal member 86 by mounting the rails 14 and 16 using screws 114 instead of or in addition to using the adhesive strips 18, as shown in FIG. 4. However, without using any screws 114, the drawer 10 is easily mounted to the horizontal member 86 without requiring any tools. An installer simply removes the non-adhesive strips 88 from the rails 14 and 16, and presses the drawer 10 upward into place in the desired location on the lower surface 84. The upper adhesive layers 82 thereby engage the lower surface 84 of the horizontal member 86 as shown in FIG. 3. The user can then move the drawer 10 longitudinally between the closed position of FIG. 2 and the opened position of FIG. 7 by grasping the tray 12 near the front surface 24 and respectively pushing or pulling the tray 12.

As many possible embodiments of the present invention may be made, and as many possible changes may be made in the embodiment set forth herein, it is to be distinctly understood that the foregoing descriptive matter is to be interpreted merely as an illustration of the invention and not as a limitation thereof. It is the Applicants' intent to include all embodiments within the scope of the accompanying claims and all equivalents thereof.

Having thus described the invention, the following is claimed:

1. An add-on drawer for mounting on a structure having a horizontal member with a lower surface, said drawer comprising: a tray having a bottom tray member extending horizontally along a longitudinal axis between front and rear ends and defining left and right ends parallel to said axis, and vertical front, rear, left, and right side walls located respectively at said front, rear, left, and right ends of said bottom tray member and defining a storage space; at least two rails, each said rail having a top surface with exclusively adhesive mounting means for mounting said rail on said lower surface, said exclusively adhesive mounting means including an upwardly facing adhesive on said top surface of said rail, two of said rails located parallel to said axis and slidably engaging and supporting said tray for movement along said longitudinal axis; and holding means for permanently preventing disengagement of said two of said rails from said tray, said drawer being mountable on said lower surface of said horizontal member by engaging said exclusively adhesive mounting means with said lower surface, and said drawer being supported exclusively by said exclusively adhesive mounting means.

2. The drawer of claim 1, wherein said adhesive is two-sided tape including a carrier layer located between an upper and lower adhesive layer, and wherein said lower adhesive layer is located between said carrier layer and said top surface of said two of said rails.

3. The drawer of claim 2, further comprising a non-adhesive strip removably connected to and completely covering said upper adhesive layer.

4. The drawer of claim 3, said holding means including a stop limiting the slidable travel of said tray with respect to said rails between a closed position wherein said storage space is entirely lateral to said two of said rails, and an open position wherein at least a portion of said storage space extends longitudinally past said two of said rails along said axis.

5. An add-on drawer for mounting on a structure having a horizontal member with a lower surface, said drawer comprising: two rails, each said rail including a top surface with exclusively adhesive mounting means for mounting said rail on said lower surface, said exclusively adhesive mounting means including an upwardly facing adhesive on said top surface of said rail, and a channel having an opening lateral to said rail, said rails being located parallel to a longitudinal axis, said channel openings of said rails facing each other; and a tray permanently attached to said rails and including at least one compartment and at least two outwardly extending members slidably engaging said channels of said rails for limited movement of said tray with respect to said rails along said axis, said drawer being mountable on said lower surface of said horizontal member by engaging said exclusively adhesive mounting means with said lower surface, and said drawer being supported exclusively by said exclusively adhesive mounting means.

6. The drawer of claim 5, further comprising a non-adhesive strip removably connected to and completely covering said upwardly facing adhesive.

7. The drawer of claim 5, further comprising a stop limiting the slidable travel of said tray with respect to said rails between a closed position and an open position, wherein said at least one compartment is entirely lateral to said rails in said closed position, and at least a portion of at least one compartment extends longitudinally past said rails along said axis in said open position.

8. A method of slidably mounting a tray onto a horizontal member with a lower surface, said method comprising the steps of:

providing a tray and two rails, each said rail having a top side with exclusively adhesive mounting means for mounting said rail on said lower surface, said exclusively adhesive mounting means including an upwardly facing adhesive, and each said rail having supports permanently engaging and slidably supporting said tray; and engaging said upwardly facing adhesive with said lower surface, thereby attaching said two rails to said horizontal member, said two rails and said tray being supported exclusively by said upwardly facing adhesive.

9. An add-on drawer for mounting on a structure having a horizontal member with a lower surface, said drawer comprising: a tray moveable along a longitudinal axis and said tray having a storage space; and two rails slidingly supporting and permanently engaging said tray for movement of said tray with respect to said rails along said axis, at least one of said rails including at least one stop permanently preventing disengagement of said rails from said tray, and each said rail having exclusively adhesive mounting means for mounting said rail on said lower surface, said exclusively adhesive mounting means including an upwardly facing adhesive mounting said rail to said lower surface of said horizontal member, said drawer being supported exclusively by said exclusively adhesive mounting means.

10. The drawer of claim 9, further comprising a non-adhesive strip removably connected to said upwardly facing adhesive.

11. The drawer of claim 9, said stop limiting the slidable travel of said tray with respect to said rails between a closed position wherein said storage space is entirely lateral to said rails, and an open position wherein at least a portion of said storage space extends longitudinally past said rails along said axis.

* * * * *